US005417283A

United States Patent [19]

Ejiogu et al.

[11] Patent Number: 5,417,283

[45] Date of Patent: May 23, 1995

[54] MIXED WELL STEAM DRIVE DRAINAGE PROCESS

[75] Inventors: Godwin Ejiogu, Calgary; Paul R. Sander, Estevan; William J. McCaffrey, Calgary, all of Canada

[73] Assignee: Amoco Corporation, Chicago, Ill.

[21] Appl. No.: 234,174

[22] Filed: Apr. 28, 1994

[51] Int. Cl.[6] ..... E21B 43/24

[52] U.S. Cl. ..... 166/272; 166/50; 166/245; 166/303

[58] Field of Search ..... 166/272, 263, 303, 50, 166/245

[56] References Cited

U.S. PATENT DOCUMENTS

| | | | |
|---|---|---|---|
| 4,344,485 | 8/1982 | Bulter | 166/272 |
| 4,598,770 | 7/1986 | Shu et al. | 166/50 X |
| 4,682,652 | 7/1987 | Huang et al. | 166/50 X |
| 5,148,869 | 9/1992 | Sanchez | 166/303 X |
| 5,211,230 | 5/1993 | Ostapovich et al. | 166/50 X |
| 5,215,146 | 6/1993 | Sanchez | 166/306 X |
| 5,273,111 | 12/1993 | Brannan et al. | 166/50 X |
| 5,339,897 | 8/1994 | Leaute | 166/50 X |

*Primary Examiner*—Stephen J. Novosad

*Attorney, Agent, or Firm*—James A. Gabala; Richard A. Kretchmer

[57] ABSTRACT

A thermal oil recovery process is disclosed for use in an oil reservoir containing a plurality of laterally separated generally vertical wells that have been used for cyclic steam stimulation and that have left in the reservoir at least one of a heated depletion zone and a channel. The process includes the steps of: drilling a well having a horizontal section and an opening therein that is located laterally between at least two of the vertical wells and at a depth within the lower part of the reservoir; injecting a heated fluid through the two vertical wells to establish thermal communication with said horizontal well; and using steam drive and gravity drainage to recover oil from the reservoir through the horizontal well.

20 Claims, 1 Drawing Sheet

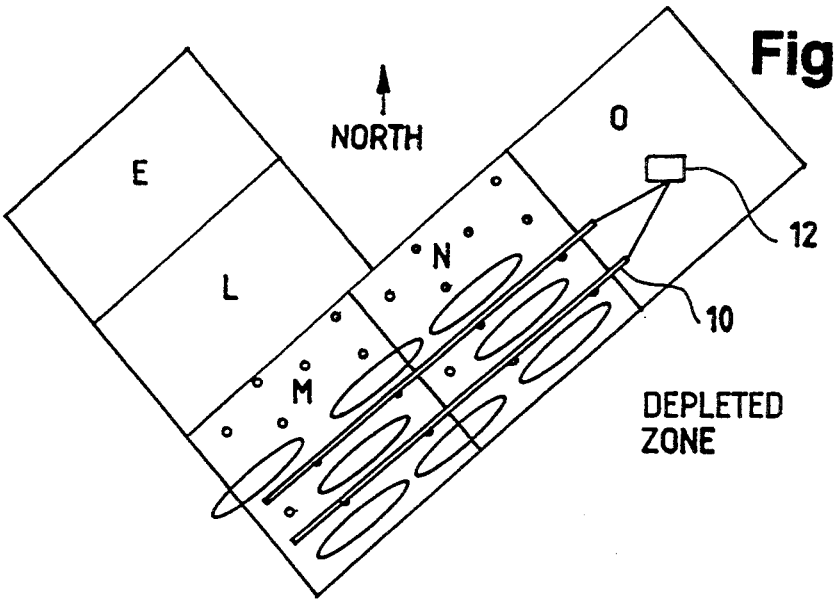
Fig. 1
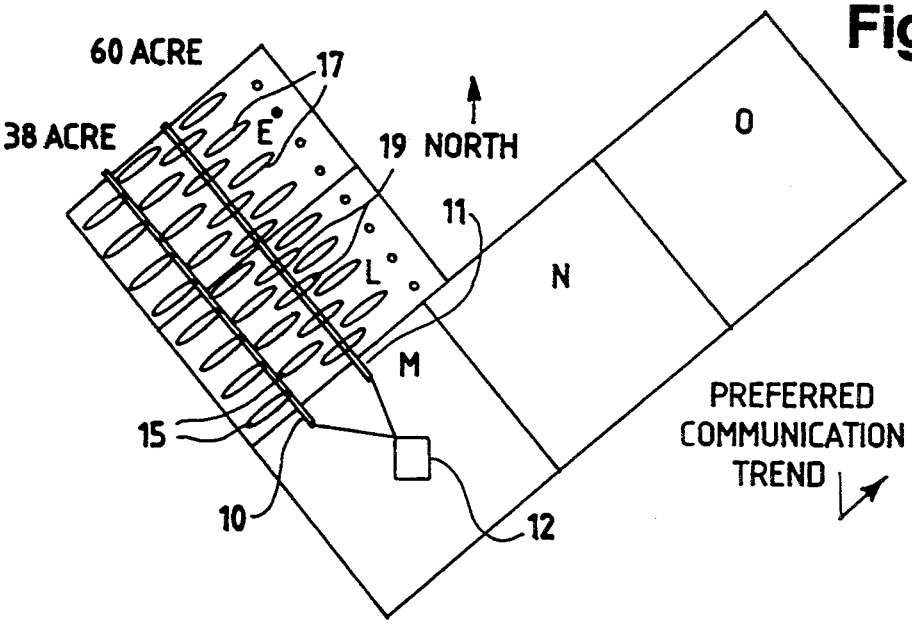
Fig. 2
Fig. 3
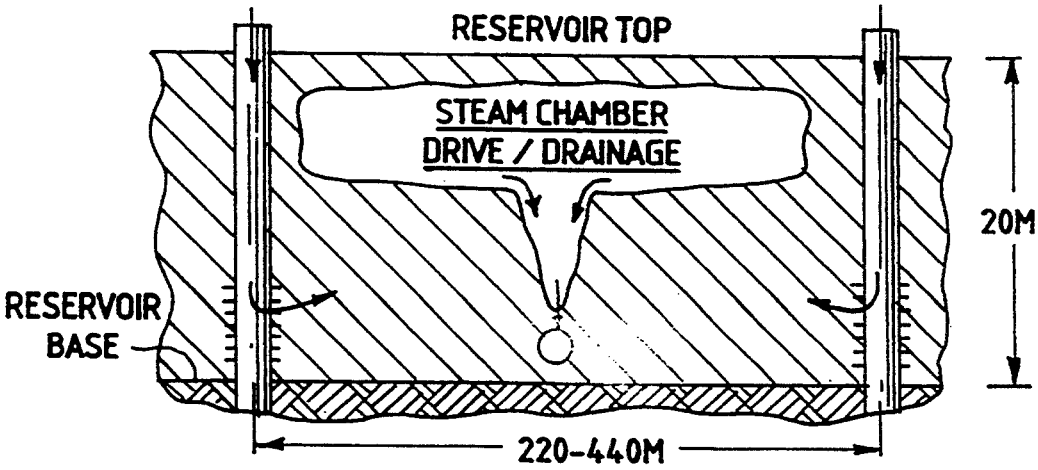

MIXED WELL STEAM DRIVE DRAINAGE PROCESS

TECHNICAL FIELD

This invention relates to the general subject of production of oil and, in particular, to a process or method for enhanced recovery of oil in underground formations which have previously experienced cyclic steam stimulation.

BACKGROUND OF THE INVENTION

There exists throughout the world major deposits of heavy oils which, until recently, have been substantially ignored as sources of petroleum since the oils contained therein were not recoverable using ordinary production techniques. For example, it was not until the 1980's that much interest was shown in the heavy oil deposits of the Alberta province in Canada even though many deposits are close to the surface and represent an estimated petroleum resource upwares of many billion barrels.

It is well known that heat can be employed to recover hydrocarbons from underground formations through wells, drilled in the underground petroleum deposits. Various methods have been developed over the years for primary and secondary recovery of oil from underground formations by thermal means.

Moreover, it is well-recognized by persons skilled in the art of recovering oil or petroleum from subterranean deposits that only a small fraction of the viscous petroleum may be recovered from subterranean formations by conventional, primary and secondary means. Some method, such as a thermal recovery process or other treatment, must often be applied to the formation to reduce the viscosity of the petroleum to a level where it will readily flow to wells from which it can be recovered to the surface of the earth. Steam and/or hot water flooding are commonly used for this purpose and have been very successful in some formations for stimulating recovery of viscous petroleum which is otherwise essentially unrecoverable. Steam flooding is a thermal oil recovery method which has enjoyed increased popularity in recent years and is often the most commercially practical method or process.

Steam flooding can be utilized in a single well by the so called "huff-and-puff" technique. That method involves first injecting steam into a vertical well, then shutting in the well for a "soak", wherein the heat contained in the steam raises the temperature and lowers the viscosity of the petroleum. Thereafter, a production period begins wherein mobilized petroleum is produced from the well, usually by pumping. This process can be repeated over and over again.

Steam flooding may also be utilized as a stem or thermal drive means or a steam through-put process, wherein stem is injected into the reservoir through one or more vertical injection wells. This steam then moves through the subterranean reservoir mobilizing and volatilizing the petroleum it encounters. This steam-flood front moves through the reservoir towards a production well wherefrom the petroleum fluids are produced. This steam drive process is often more effective than the "huff-and-puff" method inasmuch as the potential volume of the reservoir which can be swept by the process is greater.

Although the steam drive process is very effective in recovering petroleum from the portions of the reservoir through which the steam sweeps, in practice, the success of the stem drive method is often poorer because the processes inability to develop liquid communication and because of low vertical conformance efficiency. It is typical that less than 50% of a petroleum contained within a formation can be recovered by the steam drive process thereby leaving large amounts of petroleum within the reservoir after the completion of the process.

Another common thermal recovery technique is the "cyclic steam stimulation" method, wherein production of oil from a well is periodically interrupted and steam is injected into the well. The steam supplies heat to reduce the viscosity of the oil remaining in the oil-bearing strata surrounding the well so that it will flow more readily to the well for production therefrom. The cycle is repeated until the production index becomes smaller than a minimum profitable level. Sometimes the term cyclic steam stimulation and huff-and-puff are used interchangeably.

One of the problems faced with a thermal oil recovery method arises from the varying permeabilities of the reservoir. Where there is a permeable zone with a considerable increase in permeability when compared to the oil-bearing strata, the injected steam will flow into the permeable zone preferentially, or, on occasion, almost exclusively. Another problem encountered is the loss of a portion of the heat already transferred to the oil-bearing strata by the stem as a result of conduction way into the permeable zone. Clearly improvements are needed.

SUMMARY OF THE INVENTION

A general object of the invention is to improve the low ultimate recovery experienced with cyclic stem stimulation.

Yet another objective of the invention is to provide an improved means for recovery of oil that utilizes existing cyclic steam stimulation infra-structure.

Still another object of the invention is to provide a new process for the recovery of oil from undeveloped oil sands.

In accordance with the present invention a thermal recovery process is disclosed for use in a oil reservoir containing a plurality of laterally separated generally vertical wells that have been used for cyclic steam stimulation and that have left in the reservoir at least one of a heated depletion zone and a channel, the reservoir having a top and a bottom and each vertical well having a lower end located within at least part of the reservoir. In one embodiment the process comprises the steps of: drilling a well having a horizontal section and an opening therein that is located laterally between at least two of the vertical wells and at a depth within the lower part of the reservoir; injecting a heated fluid through the two vertical wells to establish thermal communication with the horizontal well, the location where the heated fluid leaves the vertical wells being relatively close to the opening in the horizontal section; and using steam drive and gravity drainage to recover oil from the reservoir through the horizontal well.

The invention is a follow-up process to cyclic stem stimulation and utilizes existing pre-heated channels for accelerated recovery, resulting in higher productivity and more economical recovery. This improvement is due, in part, to the utilization of a new horizontal well, the use of existing vertical or deviated wells and pad facilities, and the use of a combination of steam drive and gravity drainage process. A horizontal well has a greater effect that drilling more vertical wells. In other words, a properly positioned horizontal well should produce the same effect as multiple new vertical wells and at a lower cost. Moreover, the combination of steam drive and gravity damage provides high oil rates, low steam-to-oil ratios and the formation of a steam chamber which results in relatively higher water-to-oil ratios, thereby improving water resuse potential. The result is an improved oil recovery of at least 50%.

Numerous other advantages and features of the present invention will become readily apparent from the following detailed description of the invention, the embodiments described therein, from the claims, and from the accompanying drawings.

BRIEF DESCRIPTION OF THE DRAWINGS

FIG. 1 is a plan view of one arrangement of vertical and horizontal wells for the process that is the subject of the present invention;

FIG. 2 is a plan view of another arrangement of vertical and horizontal wells for the process that is the subject of the present invention; and FIG. 3 is a schematic diagram of the vertical and horizontal wells of the process that is the subject of the present invention.

DETAILED DESCRIPTION

While this invention is susceptible of embodiment in many different forms, there is shown in the drawings, and will herein be described in detail, one specific embodiment of the invention. It should be understood, however, that the present disclosure is to be considered an exemplification of the principles of the invention and is not intended to limit the invention to the specific embodiment illustrated.

This invention is a follow-up process to cyclic stem stimulation (CSS). Referring to FIG. 3, the recovery scheme or process involves drilling one or more horizontal wells between rows of existing vertical wells at the base of a reservoir. The horizontal well is used as a production well while the existing vertical wells are used as continuous injection wells. No vertical well recompletions should be needed. The horizontal wells may undergo some cyclic steaming in order to establish inter-well communication. The scheme is dominated initially by steam drive. However, after thermal communication is established between the vertical injectors and the horizontal producer, gravity drainage dominates the recovery process. The process is enhanced by the heat left in the reservoir under cyclic steam stimulation. Reservoir fluid mobility is higher than at the virgin reservoir conditions so inter-well communication and production are accelerated. Further, the process steam requirements are lessened because of the heat left behind. Reservoir simulation indicates that this follow-up process could improve ultimate recovery to as high as 50% of the original oil in place.

Referring to the drawings, in one embodiment of the invention, horizontal wells 10 were drilled from a new pad located roughly 600 meters south east of an existing pad 12, into the reservoir for a length of approximately 1280 meters. As shown in FIG. 2 the horizontal wells extend beneath pads E, L and M. Pads E, L and M are mature pads that can no longer by cyclically steamed economically. Their production histories are summarized in Table 1.

TABLE 1

| PAD (cycles) | Cumulative Recovery through April 1, 1993 Total/Average Cubic Meters | CSOR | CWOR | Fraction Total C |
|---|---|---|---|---|
| E(6) | 121304/6065 | 6.513 | 5.382 | 0.126 |
| L(7) | 124592/6922 | 6.857 | 5.008 | 0.119 |
| M(5) | 123212/7701 | 6.364 | 4.535 | 0.096 |

CSOR = Cumulative Steam Oil Ratio
CWOR = Cumulative Water Oil Ratio

Two pattern areas and configurations were tested. In FIG. 2, the two horizontal wells 10 and 11 am approximately 165 meters apart. One horizontal web 10 was drilled between two rows of existing vertical webs 15 having an effective pattern area of approximately 38 acres. The second well 11 was drilled immediately adjacent to a row of vertical wells 19 and have rows 15 and 17 on either side supporting production. Its effective pattern area is estimated to be 60 acres. The vertical webs 19 adjacent to the horizontal well 11 on the 60 acre spacing are not part of the method. Future horizontal well spacing may depend on production results of and on the spacing of existing vertical wells.

The orientation of the horizontal wells can be either parallel (FIG. 1) or perpendicular (FIG. 2) to the fracture trend found in the reservoir. Reservoir simulation has shown that performance can be superior for horizontal wells oriented perpendicular to the fracture trend.

Pressures are maintained below parting pressure (8500 kPa). Under normal operations steam injection will occur at 4500 kPa.

Bitumen saturated unconsolidated sands form the reservoir unit in one test of the invention. Examination of drill cores cut through reservoir areas shows that the reservoir is divided in descending order, into C1, C2 and C3 sands. The C1 and C2 sands are separated by about 4 meters of sandy mud. The C2 and C3 sands are separated by 45 cm of interbedded sand and mud. Tight to low permeability calcite cemented sands are abundant. A stratigraphic correlation of closely spaced wells in E, L and M pads reveals that these calcite cemented sands are laterally discontinuous.

Oil sand pay in the project area was estimated to be 15 m. No gas or water legs were evident in the area. The reservoir properties are summarized as follows:

| Reservoir unit | C3 | C2 |
|---|---|---|
| Depth of pay (meters) | 448 | 445 |
| Net oil sand pay (meters) | 15.1 | 1.8 |
| Average porosity | 32% | 28% |
| Initial water saturation | 36% | 34% |

"Net pay" is defined as sand with porosity greater than or equal to 25%, $V_{sh}$ less than or equal to 25% and GWO greater than 8%. GWO or grain weight oil is the weight percent bitumen of a dry bulk sample (water removed).

The horizontal well 10 has three main parts: a surface casing, an intermediate casing, and a horizontal slotted liner section.

The surface casing was cemented to a depth of approximately 150 meters. An intermediate hole was drilled utilizing a stabilized mud motor assembly and a MWD (measurement while drilling) system. The well was kicked off at a depth between 50 mKB and 150 mKB, with a 6°/30 meter build rate utilized to intersect the pay zone at 90° at an approximate depth of 465 meters true vertical depth (800 meters measured depth). A 298.5 mm intermediate casing (L-80 SL, 59.52 kg/m) was run to this depth and cemented to surface with a thermal cement (Class C+40% silica flour). An MWD dual induction or gamma-ray log was run on the intermediate hole. A 222 mm horizontal hole was drilled using a slick mud motor assembly and a MWD system for a total 1280 meter horizontal displacement within a 2 meter vertical target. The conductor pipe (339.7 mm, K-55 MFW, 81.1 kg/m) was set at 20 meters TVD and cemented (¾" Construction Cement, 3000 psi) to the surface. Finally, a 177.8 mm slotted liner (K-55, LT&C, 34.22 kg/m) was rim, which was not cemented.

The horizontal sections of the wells are drilled through depleted cyclic steam pads so there is some potential for drilling difficulties. Several precautions can be taken to minimize these difficulties. Temperature and fluid level surveys conducted on the existing E and L pad wells were used to determine the reservoir temperatures and pressures prior to drilling. Moreover, 2 D seismic can be used to indicate temperature changes across the pattern area, which may be related to depleted areas.

There is little potential for encountering pressurized zones near surface. Potential drilling difficulties are most likely to be either lost circulation or borehole sloughing. Lost circulation may be rectified with lost circulation materials. Observation webs may be drilled through a depleted zone to gauge the potential for sloughing, and to determine what action can be taken to remedy the problem. Finally, a directional drilling and survey program may be used to minimize interference with any existing deviated wells.

The horizontal webs can be produced using either conventional rod pumping or gas-lift systems. The wellheads were designed to handle the maximum stem injection pressure of 9,000 kPa (formation fracture pressure is approximately 8,500 kPa).

Vertical observation wells may be drilled over the project area to monitor pressure and temperature of the producing formation during steam injection operations. Observation well information may be collected using a datalogger located at each site. On a regular basis, the dataloggers transmit data back to a central computer, located at the main plant site, for further processing and reporting.

The first three years of operation are expected to produce 377,400 $m^3$ of oil, 2,409,000 $m^3$ of water and 3.8 MM $m^3$ of gas (average GOR of 10). The cumulative steam-oil ratio as expected to be 6.4. The cumulative water-oil ratio is expected to be 6.8. Table 2 outlines the projected performance of the two combined wells.

TABLE 2

| Year | Bitumen Production $m^3/d$ | SOR Instantaneous | WOR Instantaneous |
|---|---|---|---|
| 1 | 209 | 8.2 | 11.2 |
| 2 | 414 | 5.0 | 5.2 |
| 3 | 411 | 4.9 | 5.1 |
| 4 | 308 | 6.0 | 6.3 |
| 5 | 189 | 5.5 | 5.8 |
| 6 | 168 | 6.3 | 6.6 |
| 7 | 148 | 7.3 | 7.7 |
| 8 | 141 | 7.6 | 8.0 |
| 9 | 125 | 7.2 | 8.3 |
| 10 | 109 | 9.3 | 8.9 |
| 11 | 88 | 9.6 | 10.1 |

TABLE 2-continued

| Year | Bitumen Production $m^3/d$ | SOR Instantaneous | WOR Instantaneous |
|---|---|---|---|
| Average | 210 | 6.3 | 6.9 |

No modifications should be needed for the CSS control facilities which consist of equipment necessary for bitumen treatment, water disposal, stem generation, and fuel gas processing.

This process should not necessitate immediate or long term increase in the consumption of fresh water for steam generation. Table 3 illustrates the projected steam and water requirements.

TABLE 3

| Year | Steam CWE (1000 $m^3$) | Produced Water (1000 $m^3$) | Make-Up Water (1000 $m^3$) | Excess/Disposed Water (1000 $m^3$) |
|---|---|---|---|---|
| 1 | 631 | 858 | 0 | 227 |
| 2 | 754 | 782 | 0 | 29 |
| 3 | 742 | 769 | 0 | 27 |
| 4 | 678 | 709 | 0 | 30 |
| 5 | 379 | 398 | 0 | 20 |
| 6 | 384 | 406 | 0 | 22 |
| 7 | 392 | 413 | 0 | 21 |
| 8 | 391 | 410 | 0 | 20 |
| 9 | 362 | 379 | 0 | 17 |
| 10 | 336 | 354 | 0 | 17 |
| 11 | 308 | 323 | 0 | 14 |
| Cumulative | 5355 | 5802 | 0 | 475 |

This information is based on numerical simulation, wherein it was assumed that the process of the invention is independent of other operations in the area. In practice, any excess water produced would be recycled to make up for shortfalls elsewhere, rather than disposed.

The simulation predicted greater water production than steam injection. This imbalance results because the produced fluids that are drained from the steam chamber have a greater volume than the condensed equivalent volume of stem. Moreover, the reservoir has higher than virgin water saturation due to prior cyclic steam operations, so this also contributes to the imbalance.

High resolution, high frequency 3 D reflection seismic data may be used to remotely monitor steam progression. A Surface Displacement Monitoring Technology (SDMT) program may be used to determine the distribution of steam during the project along with a 3 D seismic. This program may require cut lines across the entire site so that surface heave monuments can be installed.

From the foregoing description, it will be observed that numerous variations, alternatives and modifications will be apparent to those skilled in the art. Accordingly, this description is to be construed as illustrative only and is for the purpose of teaching those skilled in the an the manner of carrying out the invention. Various changes may be made, materials substituted and features of the invention may be utilized. For example, the invention is applicable to reservoirs that have been depleted through water-flooding as well as to fractured and non-fractured reservoirs. Moreover, while steam is the preferred fluid, other fluids, such as hot water, having a temperature greater than that of the underground formation, should be considered. Thus, it will be appreciated that various modifications, alternatives, variations, etc., may be made without departing from the spirit and scope of the invention as defined in the appended claims. It is, of course, intended to cover by the appended claims all such modifications involved within the scope of the claims.

We claim:

1. In a oil reservoir containing a plurality of laterally separated generally vertical wells that have been used for cyclic steam stimulation and that have left in the reservoir at least one of a heated depletion zone and a channel, the reservoir having a top and a bottom and each vertical well having a lower end located within at least part of the reservoir, a thermal recovery process comprising the steps of:

a) drilling a well having a horizontal section and an opening in said section that is located laterally between at least two of the vertical wells and at a depth within the lower part of the reservoir;

b) injecting a heated fluid through said at least two vertical wells to establish thermal communication with said horizontal well, the location where said heated fluid leaves said vertical wells being relatively dose to said opening in said horizontal section; and c) using steam drive and gravity drainage to recover oil from the reservoir through said horizontal well.

2. The process of claim 1, wherein step (b) is performed using steam as the heated fluid.

3. The process of claim 2, where in step (b) said heated fluid is injected continuously through the vertical wells at a high rate such that the fracture pressure of the reservoir is not exceeded.

4. The process of claim 2, further including the step of cyclically steaming said horizontal well to establish inter-well communication prior to using steam drive and gravity drainage to recover oil through said horizontal well.

5. The process of claim 1, wherein the reservoir is a heavy oil reservoir that has been at least partially depleted through water flooding.

6. The process of claim 5, wherein the reservoir has been depleted under primary production without fracturing.

7. The process of claim 1, wherein at least one of said two vertical wells and said horizontal well intersect a high-mobility pre-heated channel that was formed in the reservoir during cyclic steam stimulation.

8. The process of claim 2, where in step (b) steam injected through the vertical wells dominates over gravity drainage for a predetermined time interval.

9. The process of claim 8, wherein after said predetermined time interval gravity drainage dominates that due to steam.

10. The process of claim 1, wherein prior to injecting said heated fluid through said two vertical wells, the reservoir is pumped-off.

11. The process of claim 1, wherein said horizontal well has a build section located outside of the known extent of the depleted reservoir.

12. The process of claim 1, wherein the reservoir has at least one predetermined fracture trend direction, and in step (a) said horizontal well is drilled generally perpendicular to said direction.

13. The process of claim 1, wherein the reservoir is characterized by a fracture pressure, and where in step (b) said heated fluid is injected at a pressure that is less than said fracture pressure.

14. In an at least partially depleted oil reservoir containing at least four generally vertical wells that have been used for cyclic steam stimulation and that have left in the reservoir at least one high-mobility pre-heated channel that was formed in the reservoir during cyclic steam stimulation, the vertical wells having bottom ends located within said reservoir and upper ends that define a quadrilateral on the surface of the earth, a thermal recovery process comprising the steps of:

a) drilling a horizontal well having a horizontal section that is located in the lateral space between two opposite sides of the quadrilateral formed by the four generally vertical wells and that is located at the lower part of the reservoir, at least one of said two vertical wells and said horizontal well intersecting a high-mobility pre-heated channel that was formed in the reservoir during cyclic steam stimulation, said horizontal well having a build section located outside of the known lateral extent of the at least partially depleted oil reservoir and having openings in said horizontal section that are located laterally between the vertical wells;

b) cyclically steaming said horizontal well and and at least two of the generally vertical ,wells to establish inter-well communication;

c) continuously injecting steam through said at least said two generally vertical wells to thermally communicate with said horizontal well, the location where said steam leaves said at least two generally vertical wells being relatively close to, said openings in said horizontal section and the pressure of said steam being less than the fracture pressure of the reservoir; and d) using the driving force of said steam to recover heated oil from the reservoir through said horizontal well for a predetermined time interval and thereafter using gravity drainage to recover oil from said reservoir.

15. The process of claim 14, wherein the reservoir has at least one predetermined fracture trend direction, and in step (a) said horizontal well is drilled generally perpendicular to said direction.

16. In an at least partially depleted off reservoir containing rows of generally vertical wells that have been used for cyclic steam stimulation and that have left in the reservoir at least one high-mobility pre-heated channel that was formed in the reservoir during cyclic steam stimulation, the reservoir having at least one predetermined fracture trend direction, a thermal recovery process comprising the steps of:

a) drilling, in the reservoir in the direction perpendicular to the fracture trend, a horizontal well having a horizontal section that is located in the lateral space between the two rows of vertical wells and that is located at a depth at the lower part of the reservoir, at least one of the vertical wells and said horizontal well intersecting a high-mobility pre-heated channel that was formed in the reservoir during cyclic steam stimulation;

b) continuously injecting steam, through said at least said one vertical well and an adjacent vertical well in the opposite row, to thermally communicate with said horizontal well, the pressure of said steam being less than the fracture pressure of the reservoir; and c) using the driving force of said steam to recover heated oil from the reservoir through said horizontal well for a predetermined time interval and thereafter using gravity drainage to recover oil from said reservoir.

17. The process of claim 16, wherein the reservoir is a heavy oil reservoir that has been at least partially depleted through water flooding.

18. The process of claim 16, wherein the reservoir has been depleted under primary production without fracturing.

19. The process of claim 16, wherein prior to completing step (b) the reservoir is pumped-off.

20. The process of claim 16, wherein said horizontal well of step (a) has a build section located outside of the known extent of the depleted reservoir.

* * * * *

UNITED STATES PATENT AND TRADEMARK OFFICE

CERTIFICATE OF CORRECTION

PATENT NO. : 5,417,283

DATED : May 23, 1995

INVENTOR(S) : Godwin Ejiogu, Paul R. Sander, William J. McCaffrey

It is certified that error appears in the above-indentified patent and that said Letters Patent is hereby corrected as shown below:

| Col. | Line | |
|---|---|---|
| 2 | 27 | "oil-bearing strata by the stem" should read --oil-bearing strata by the steam-- |
| 2-3 | 68-1 | "A horizontal well has a greater effect that drilling more vertical wells." should read --A horizontal well has a greater effect than drilling more vertical wells.-- |
| 3 | 37-38 | "This invention is a follow-up process to cyclic stem stimulation (CSS)." should read --This invention is a follow-up process to cyclic steam stimulation (CSS).-- |
| 4 | 12-13 | "horizontal wells 10 and 11 am approximately 165 meters apart." should read --horizontal wells 10 and 11 are approximately 165 meters apart.-- |
| 4 | 13 | "One horizontal web 10" should read --One horizontal well 10-- |

UNITED STATES PATENT AND TRADEMARK OFFICE

CERTIFICATE OF CORRECTION

PATENT NO. : 5,417,283

DATED : May 23, 1995

INVENTOR(S) : Godwin Ejiogu, Paul R. Sander, William J. McCaffrey

It is certified that error appears in the above-indentified patent and that said Letters Patent is hereby corrected as shown below:

| Col. | Line | |
|---|---|---|
| 4 | 14 | "two rows of existing vertical webs 15" should read --two rows of existing vertical wells 15-- |
| 5 | 13-14 | "Finally, a 177.8 mm slotted liner (K-55, LT & C, 34.22 kg/m) was rim," should read --Finally, a 177.8 mm slotted liner (K-55, LT & C, 34.22 kg/m) was run,-- |
| 5 | 30 | "Observation webs may be drilled" should read --Observation wells may be drilled-- |
| 5 | 36 | "The horizontal webs" should read --The horizontal wells-- |
| 7 | 19-20 | "said vertical wells being relatively dose to said opening" should read --said vertical wells being relatively close to said opening-- |

Signed and Sealed this

Fifth Day of March, 1996

Bruce Lehman

*Attest:*

BRUCE LEHMAN

*Attesting Officer*

*Commissioner of Patents and Trademarks*